United States Patent [19]

Hildebrandt et al.

[11] Patent Number: 4,875,577

[45] Date of Patent: Oct. 24, 1989

[54] MULTICHAMBER CONTAINER

[75] Inventors: Bodo Hildebrandt, Riedstadt; Franz Steigerwald, Griesheim, both of Fed. Rep. of Germany

[73] Assignee: Wella Aktiengesellschaft, Darmstadt, Fed. Rep. of Germany

[21] Appl. No.: 208,299

[22] PCT Filed: Sep. 9, 1987

[86] PCT No.: PCT/EP87/00508

§ 371 Date: Apr. 14, 1988

§ 102(e) Date: Apr. 14, 1988

[87] PCT Pub. No.: WO88/01973

PCT Pub. Date: Mar. 24, 1988

[30] Foreign Application Priority Data

Sep. 12, 1986 [DE] Fed. Rep. of Germany ..... 3631133

[51] Int. Cl.[4] ..... B65D 25/08

[52] U.S. Cl. ..... 206/219; 215/DIG. 8

[58] Field of Search ..... 206/219, 221, 222; 215/DIG. 8

[56] References Cited

U.S. PATENT DOCUMENTS 3,508,680 4/1970 Hollis .

FOREIGN PATENT DOCUMENTS 2342914 9/1977 France .
2370650 6/1978 France .

*Primary Examiner*—Joseph Man-Fu Moy
*Attorney, Agent, or Firm*—Michael J. Striker

[57] ABSTRACT

A multichamber container with no compressed gas therein comprises an outer container and an inner container for pourable substances which are to be kept separate. The substances may be combined inside the container for the purpose of extracting a mixture of substances. The inner container has an open end which is connected to an inner side of a cap with positive locking, in a non-rotatable and axially detachable manner, and has at least one projection on the outside wall. The outer container is connected to the rotatable cap by means of a snap connection and has at least one projection on the inside wall. The projectins of both containers are formed in such a manner that they intercommunicate for combining the substances by rotation of the cap. The inner container is axially detachable from the cap.

19 Claims, 6 Drawing Sheets

MULTICHAMBER CONTAINER

BACKGROUND OF THE INVENTION

The invention relates to a multichamber container which has no compressed gas and includes an outer and an inner container for pourable substances which are to be kept separate, whereby the substances may be combined inside the container for the purpose of extracting a mixture of substances.

Such containers are known in the most varied embodiments and have the disadvantage that they are complex in construction, awkward to handle and difficult to assemble.

It is known from U.S. Pat. No. 4 024 952 to provide a threaded rotatable cap which lifts off the separating lid with a great force by means of a counter screw connection of the inner container for the purpose of combining substances.

SUMMARY OF THE INVENTION

The object of the invention is to provide an improved multichamber container which has no compressed gas. It is another object of the invention to provide a container which is simple to handle, has secure inner container sealing means and is simple to assemble automatically, and which container permits the substances to be combined using a minimum force when the rotating cap is rotated slightly.

This and other objects of the invention are attained by a multichamber container having no compressed gas therein and comprising an outer container and an inner container each containing a pourable substance, wherein the substances are to be kept separate but to be extracted from the multichamber container as a mixture of the substances, the substances being combined inside the container, said outer container having an upper side; a rotatable cap; and a catch joint, the upper side of the outer container being connected to said rotatable cap with positive locking by said catch joint; said inner container having an open end at an upper side thereof, said cap having an inner side, said open end at the upper side of the inner container being connected to said inner side of the cap with positive locking and in a non-rotational and axially detachable manner; the inner container having at least one projection on an outer wall thereof; the outer container having at least one projection on an inner wall thereof; said at least one projection of said inner container and said at least one projection of said outer container being formed in such a way that they come to communicate with one another by an axial turning of said cap to cause the inner container to be axially detachable from the cap; the cap being provided with a sealable extraction on the upper side.

The combining of the substances contained in the multichamber container for the purpose of producing a mixture of substances is advantageously achieved by the provision of projections on one side of the inside wall of the outer container, the projections communicating with the projections of the outer wall of the inner container, which are disposed on diametrically opposed sides, in such a manner that when the cap is turned, the projections are axially displaced and thus the inner container is released from the cap connection and falls into the outer container with its contents. By shaking the multichamber container, it is possible to obtain a homogeneous mixture of substances via the loose inner container. The cap seal is opened in order to remove this mixture.

According to requirements, the projections can have various shapes, e.g. the outer container projections have a horizontally oriented plane on the lower side, but the inner container projections have a radial, oblique plane on the upper side, or the outer container projections have an oblique plane on the lower side, and the inner container projections have a radial, horizontal plane on the upper side.

In an alternative embodiment of the projections, the outer container projections have symmetrically wedge-shaped oblique planes on the lower side, but the inner container projections have a horizontal plane on the upper side, whereby any rotational direction of the cap is possible for the separating operation. The same applies if the outer container projections have a horizontal plane on the lower side and the inner container projections have a symmetrically wedge-shaped oblique plane on the upper side.

Advantageously, by virtue of (symmetrically wedge-shaped) oblique planes on the upper side of the outer container projections, when the inner container is inserted into the outer container, the former is forcibly oriented by means of the inner container projections in such a manner that the inner container connected to the cap can be placed loose in the outer container.

For the sake of a simple construction, the inner container is formed like a beaker.

To provide a liquid-proof fit for the open end of the inner container, the cap has a sealing ring on the inside of its lid.

In a further embodiment of the invention the inner container has an axial projection towards its open side forming a non-rotatable and axially detachable connection with the cap, e.g. such that the projection has a polygonal profile in its end region, the beginning of the extraction channel of the cap having a corresponding polygonal profile for the purpose of forming a non-rotatable and axially detachable connection with the cap.

An improved non-rotatable and axially detachable connection is obtained by arranging two diametrically opposed projections on the outside of the projection, the projections communicating with a transverse, funnel-shaped recess of a hollow cylindrical centering device, whereby the point of junction of the inner container with the cap is determined and the inner container undergoes compulsory orientation in the recess in the joining operation via the two projections by means of the centering device.

In another advantageous embodiment of the invention, the end region of the projection is formed as a stopper closing the extraction channel, whereby an erroneous extraction of only an unmixed substance is prevented, or the extraction of a substance from the multichamber container is only possible if the two substances have been combined by the turning of the cap.

Within the scope of the invention, the inner container can be made with a plurality of concentric cylindrical chambers, so that more than two different substances can be kept separate.

In a further advantageous embodiment of the invention, the projection is shaped as a tube in such a manner that it connects the extraction channel to the outer container chamber, so that it is possible to extract a prescribed, limited amount from the outer container chamber.

The projection and the inner container are advantageously integral with one another, so that they may be manufactured economically.

It is possible to achieve a directed, metered application of the substance mixture by making the outer container compressible. This can be achieved either by making the outer container with an elastic wall or by making the outer container wall bellow-shaped.

The following describes the invention through a number of embodiments with the aid of partially diagrammatic representations.

DETAILED DESCRIPTION OF THE PREFERRED EMBODIMENTS

Figure 1:
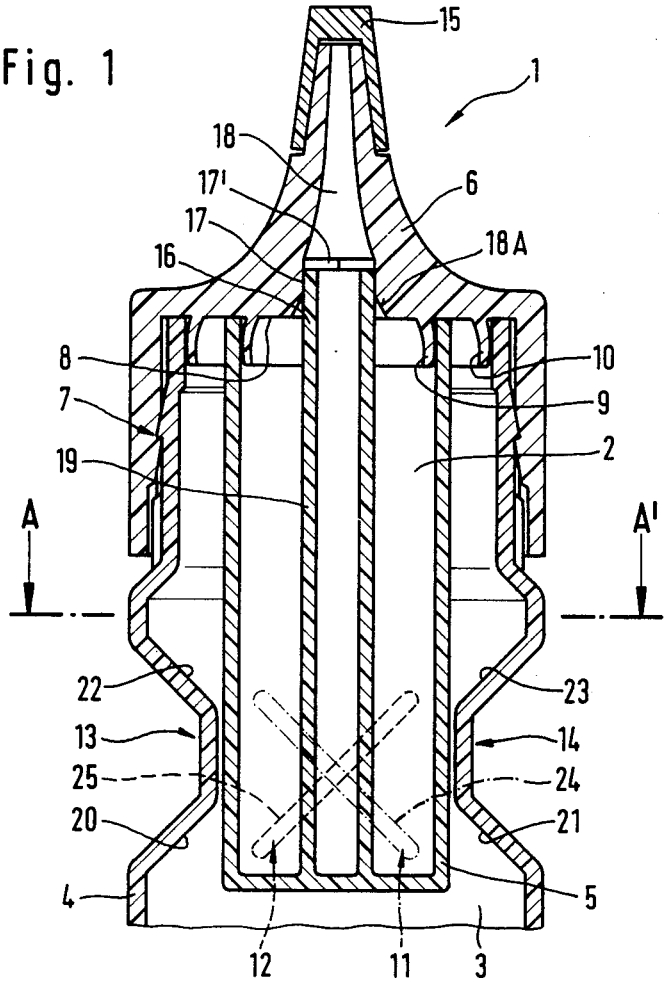
FIG. 1 shows in axial section the upper part of a multichamber container.
Figure 4:
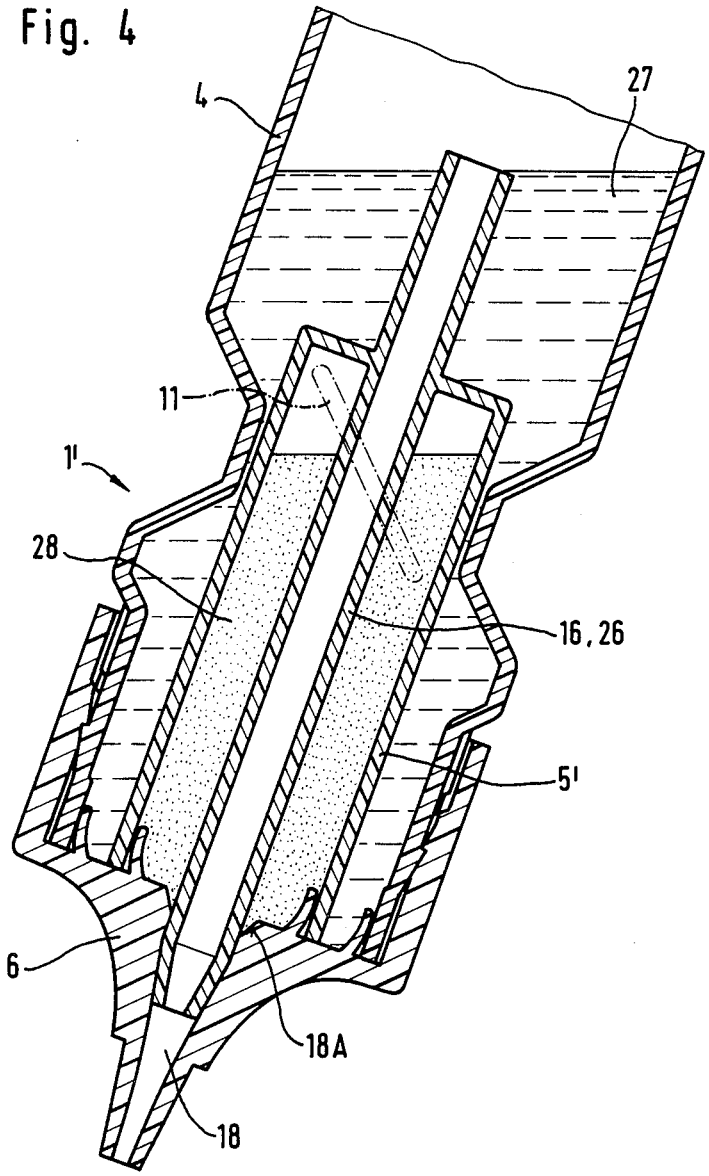
FIG. 4 an axial section through the multichamber container in application position with a limitation of the volume extracted from the outer container chamber.

FIG. 1 shows a multichamber container 1 designed for storing pourable substances which are to be kept separate (the substances are shown in FIG. 4). The substances which are to be kept separate are received in the inner container chamber 2 and in the outer container chamber 3, respectively. The inner container 5 projects into the center of the outer container 4. The outer container 4 is connected to a sealing, rotatable cap 6 by means of a snap connection 7. The open end of the inner container 5 is connected to the inside 8 of the cap 6 in a water-tight, non-rotatable and axially detachable manner. For the sake of a liquid-tight fit of the open end of the inner container 5, the cap is provided with a sealing ring 9 on the inside of the lid. A further sealing ring 10 seals the outer container chamber 3 in liquid-tight manner. The inner container 5 has two diametrically opposed projections 11, 12 on the outer wall; the outer container 4 has two diametrically opposed projections 13, 14 on the inside wall. In addition, the projections 11, 12, 13, 14 are arranged in such a manner that they intercommunicate when the cap 6 is turned, and that the oblique projections 11, 12 are pressed axially downwards from the lower side of the outer container projections 13, 14 during rotation of the cap 6, thus releasing the inner container 5 from the cap 6. In the embodiment illustrated here, the inner container is released by anticlockwise rotation. Now the substances can be mixed by shaking the multichamber container 1. The loose inner container 5 supports the mixing operation while the multichamber container 1 is shaken. To remove the substance mixture, the seal 15 is removed from the cap 6.

The inner container 5 is joined non-rotatably to the cap 6 in that the inner container 5 has an axial projection 16 towards its open side, a polygonal profile being provided in the end region of the projection 16 and the beginning of an extraction channel 18 of the cap 6 having a corresponding polygonal profile for receiving the projection 16.

The axial projection 16 is designed to act as the stopper sealing the extraction channel 18. An erroneous extraction from the multichamber container of only one substance is thereby prevented. Only after the cap is turned can a substance mixture be extracted via the extraction channel.

The axial projection 16 is advantageously formed in such a manner that it extends from the bottom of the inner container 5. A centering device 18 A for the axial projection 16 or inner container 5 consists of a funnel which opens into the beginning of the extraction channel 18.

Figure 2:
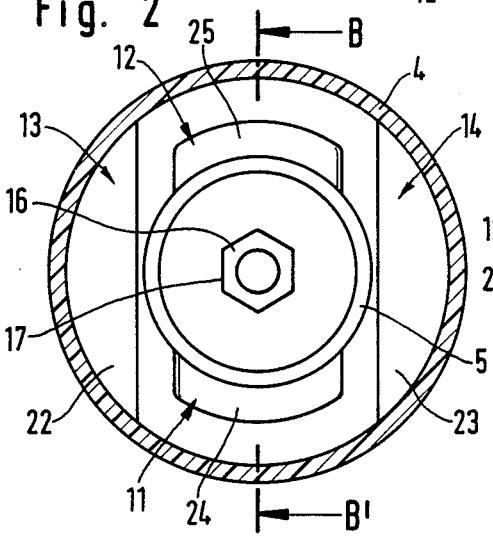
FIG. 2 a section A—A' according to FIG. 1, but with a plan view of the inner container.

FIG. 2 shows a section diagram along section line A—A' from FIG. 1, but without a section through the inner container 5 or with a plan view of the inner container 5. FIG. 2 illustrates in particular the projections 11, 12, 13, 14 and the axial projection 16 with a polygonal profile 17. If the inner container 5 is turned anticlockwise by means of the cap 6, the two projections 11, 12 touch the lower side of the projections 13, 14 in a first position. Due to the oblique position of the projections 11, 12, further turning causes the inner container 5 to be displaced downwards in the axial direction, so that after a rotation of approximately 90° the inner container 5 is separated from the cap 6.

Figure 3:
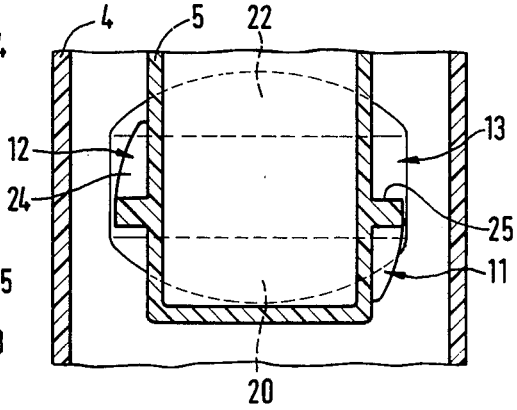
FIG. 3 a section diagram along B—B' from FIG. 2, but defined by the section line A—A'.

FIG. 3 shows diagrammatically a section taken along the section line B—B' from FIG. 2, but with an upper boundary of the section line A—A' from FIG. 1. This shows more clearly how the projections 11, 12 communicate with the lower side plane 20 of the outer container projections 13, 14.

The planes 22, 23 of the upper sides of the projections 13, 14 represent an assembly aid, whereby upon insertion in the multichamber container 1 the projections 11, 12 are oriented along the planes 22, 23 in such a manner that the projections 11, 12 pass through the projections 13, 14 unhindered. The planes 24, 25 of the upper sides of the projections 11, 12 are in contact with the planes 20, 21 of the lower sides of the projections 13, 14 during the separation operation.

In a further embodiment, FIG. 4 shows the inner container 5' with an axial projection 16, which is shaped as a pipe 26 and connects the extraction channel 18 to the outer container chamber 3 in a liquid-tight manner. In order to facilitate assembly, the pipe 26 opening into the extraction channel is conical. According to the length of the pipe 26 inside the outer container chamber 3, a maximum extractable volume of the substance 27 in the outer container chamber 3 can be limited. FIG. 4 shows the condition of this limitation. A further extraction of this substance 27 and of the other two substances can occur if the substances are mixed, and to this end the container is closed again with the seal 15 and the inner container 5' released from the cap 6 by rotation of the cap 6. A homogeneous mixture of the two substances 27, 28 is obtained by a brief shaking of the multichamber container 1. To extract a substance mixture, the seal 15 is then removed again.

Figure 5:
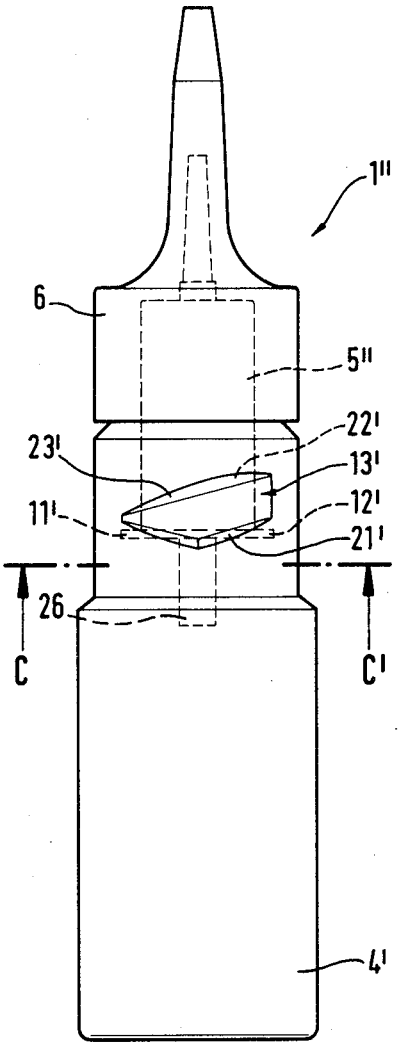
FIG. 5 a side view of a multichamber container.
Figure 6:
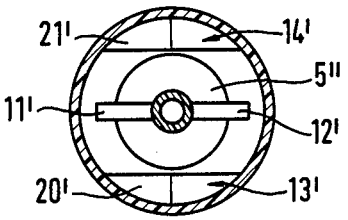
FIG. 6 a section diagram along the line C—C' from FIG. 5.

FIGS. 5 to 8 show differently shaped outer container projections 13', 14' or 13'', 14''. FIGS. 5 and 6 show cylindrically formed inner container projections 11', 12'. The projections 13', 14' have symmetrically wedge-shaped oblique planes 20', 21' on the lower side. The inner container 5'' can thus be separated by any rotational direction of the cap 6. On their upper side, the projections 13', 14' have an oblique plane 22', 23', the projections 11', 12' can slide along the oblique planes 22', 23' of the upper sides of the projections 13', 14' for the purpose of automatically crossing the projections 13', 14' according to a bearing position according to FIG. 5.

Figure 7:
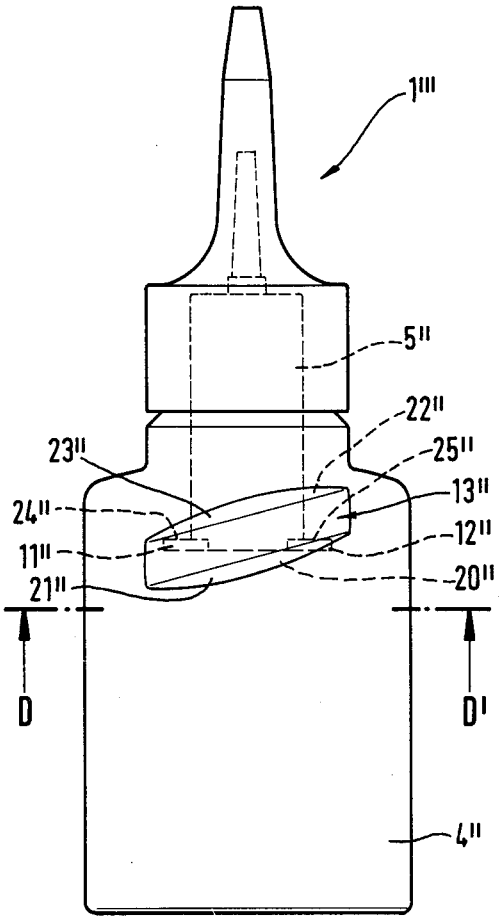
FIG. 7 a side view of an oval multichamber container.
Figure 8:
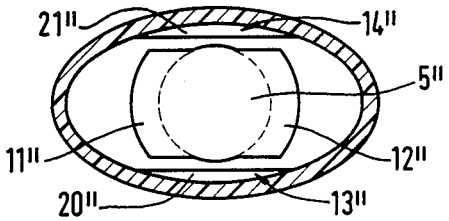
FIG. 8 a section diagram along the line D—D' from FIG. 7.

Unlike the multichamber containers illustrated so far, the multichamber container according to FIGS. 7 and 8 is oval-shaped with its outer container 4. In this case the projections 11'', 12'' are oriented transverse to the axis of the multichamber container; the projections 13'', 14'', on the other hand, have oblique planes 22'', 23'' or 13'', 14'' extending in parallel on their upper and lower sides. The projections 11'', 12'', 13'', 14'' communicate advantageously in such a manner that the inner container 5'' is separated from the cap 6 by a cap rotation of approximately 120°.

Figure 9:
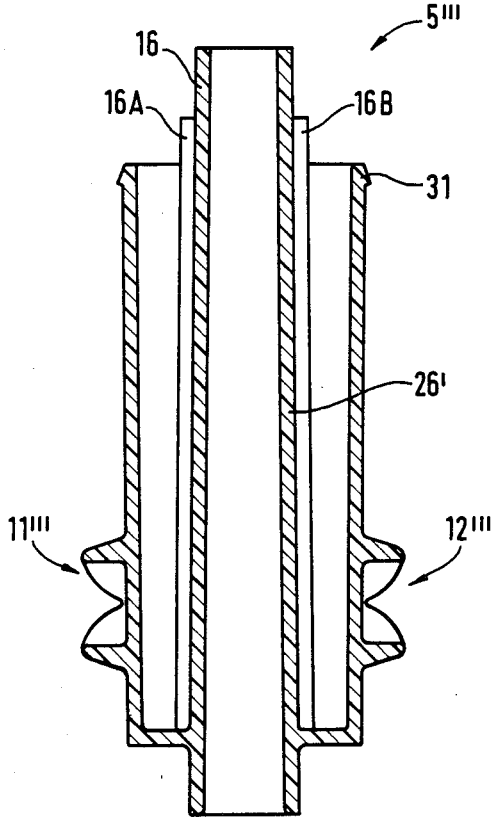
FIGS. 9 to 12 various views of an inner container for a preferred centering device.

A preferred embodiment of a multichamber container 1'''' is shown in detail in FIGS. 9 to 18. Thus FIG. 9 shows an inner container 5''' in axial section traversed by a pipe 26' extending in the axial direction. Two diametrically opposed projections 11''', 12''' are disposed on the outside of the lower region of the inner container 5'''. On the outside of the pipe 26' two diametrically opposed projections 16 A, 16 B extend from the inner base of the inner container 5'''. Two diametrically opposed projections 11''', 12''' are disposed on the outside of the lower region of the inner container 5''', having the shape of a rhombus (see also FIG. 11).

Figure 10:
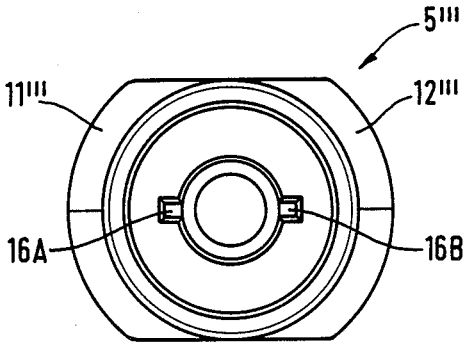

For the sake of clarity, the inner container 5''' is represented in plan view in FIG. 10.

Figure 11:
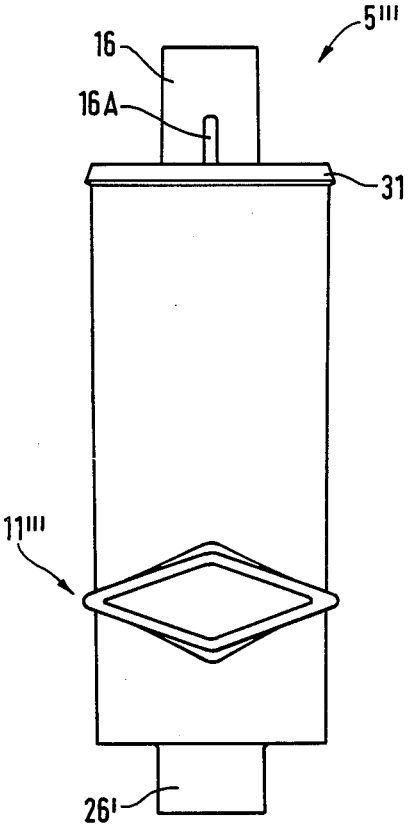

A side view of the inner container 5''' according to FIG. 9 and rotated by 90° is shown in FIG. 11. The rhombus shape of the projections 11''', 12''' is particularly prominent in this figure. A continuous ring 31 is disposed on the edge of the outside of the inner container to act as a snap connection with the cap 6.

Figure 12:
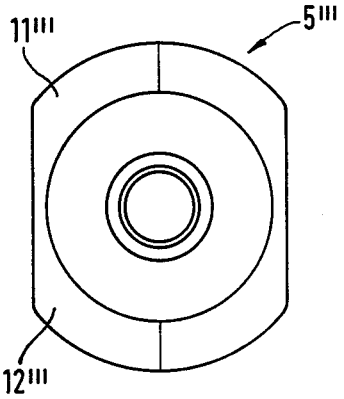

FIG. 12 shows a view of the lower side of the inner container 5'''. This clearly shows that the width of the projections 11''', 12''' approximately corresponds to that of the diameter of the inner container 5'''.

Figure 13:
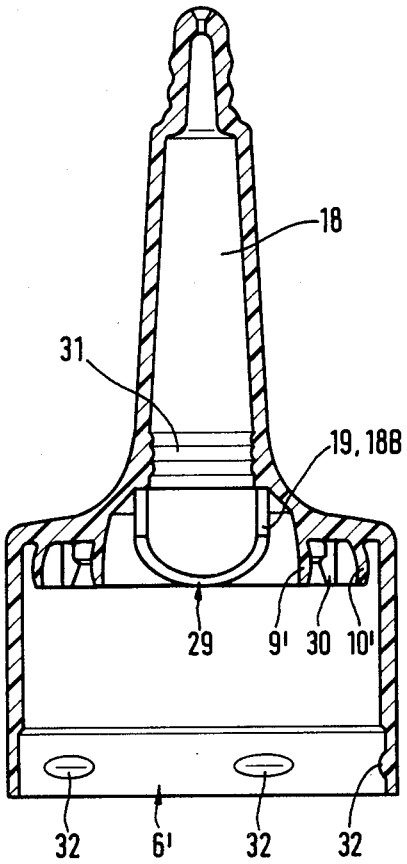
FIGS. 13 to 15 various views of a cap with a preferred centering device.

FIG. 13 shows a cap 6' in axial section with a centering device 18 B. A sealing ring 10' is provided as a liquid-tight joint between the cap 6' and the outer container 4'''. A further sealing ring 9' acts as a liquid-tight connection between the cap 6' and the inner container 5'''. An interrupted snap connection ring 30 is disposed between the sealing rings 9', 10' to ensure a secure connection between the cap 6' and the inner container 5'''. Sealing rings 31 are provided in the lower region of the extraction channel 18 as a liquid-tight connexion between the extraction channel 18 and the axial projection 16 or the pipe 26' of the inner container 5'''. Protrusions 32 are disposed inside the lower region of the cap 6' as a snap connection 7 with the outer container 4'''.

Figure 14:
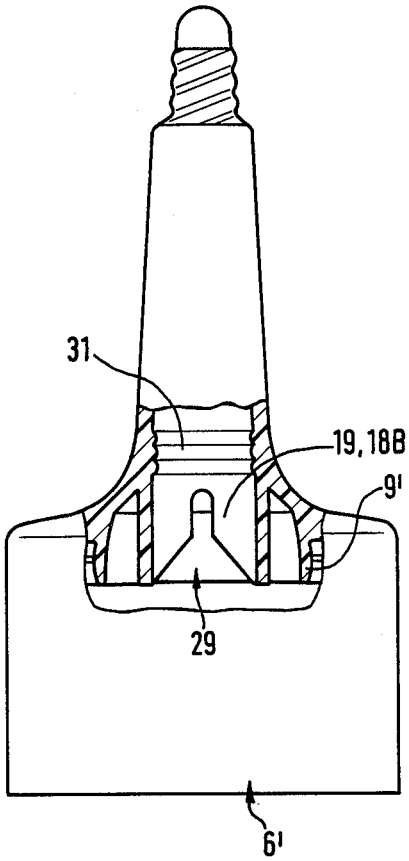

FIG. 14 shows a view rotated axially about 90° C. This shows particularly clearly the funnel-shaped recess 29 on the hollow cylindrical projection 19 of the centering device 18 B. The narrower region of the recess 29 serves as a fit for the two projections 16 A, 16 B of the inner container 5'''.

Figure 15:
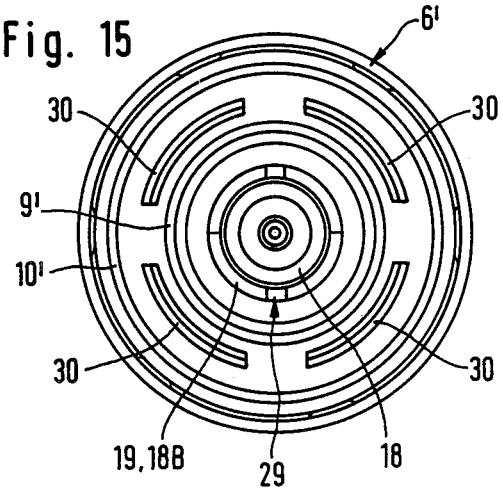

FIG. 15 shows a view of the cap 6' from below, the interrupted snap connection ring 30 being shown particularly clear.

Figure 16:
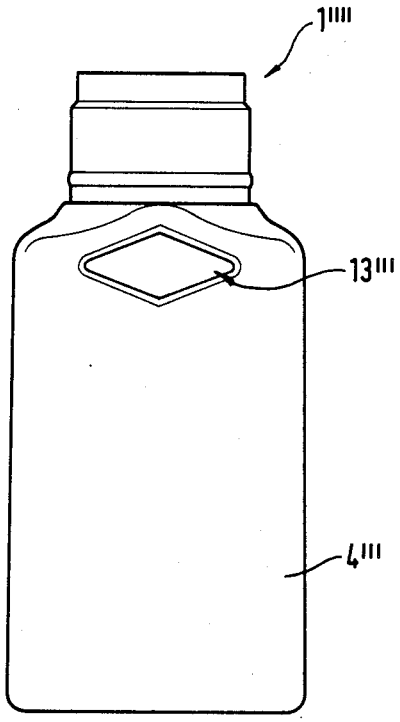
FIGS. 16 to 18 various views of an outer container corresponding to FIGS. 9 to 15 on a reduced scale.
Figure 18:
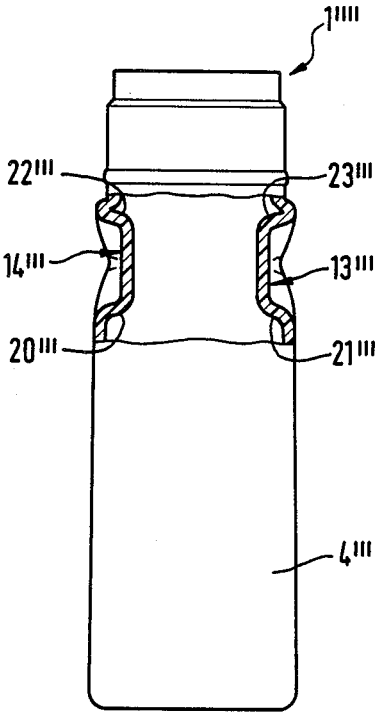
Figure 17:
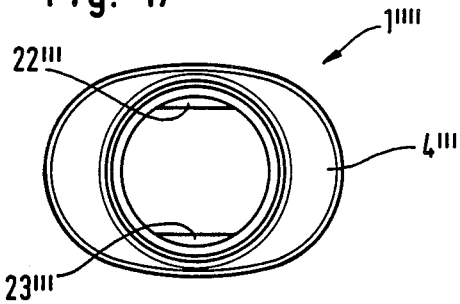

An outer container 4''' corresponding to the inner container 5''' and the cap 6' is shown in FIGS. 16 to 18. The projections 13''', 14''' are rhombus-shaped in the form of detents in the outer container 4'''.

It will be understood that each of the elements described above, or two or more together, may also find a useful application in other types of multichamber containers differing from the types described above.

While the invention has been illustrated and described as embodied in a multichamber container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a multichamber container having no compressed gas therein and comprising an outer container and an inner container each containing a pourable substance wherein said substances are to be kept separate but to be extracted from said multichamber container as a mixture of said, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at said upper side of said inner container being connected to said inner side of said cap with positive locking and in a nonrotational and axially detachable manner;

(c) an outer wall of said inner container having two diametrically opposed projections, each of said projections having a radial, oblique plane on upper sides thereof; and (d) an inner wall of said outer container having two diametrically opposed projections, each of said projections having a horizontally oriented plane on undersides thereof, said projections being formed in such a way that said projections come to communicate with one another by an axial turning of said cap to cause said inner container to be axially detachable from said cap; said cap being provided with a sealable extraction canal.

2. A multichamber container according to claim 1, wherein the inner container (5, 5') has an axial projection (16) extending towards the open end, said projection forming a non-rotatable and axially detachable connection with the cap (6).

3. A multichamber container according to claim 2, wherein the axial projection (16) has a polygonal profile in an end region thereof, and a beginning of the extraction canal (18) of the cap (6) has a profile (17') complementary to the polygonal profile.

4. A multichamber container according to claim 2, wherein a beginning of the extraction channel (18) is provided with an auxiliary centering means (18A).

5. A multichamber container according to claim 2, wherein the axial projection (16) has an external wall and two diametrically opposed projections (16A, 16B) formed on said external wall, said cap including an auxiliary centering means (18B), said opposed projections communicating with said auxiliary centering means on the cap.

6. A multichamber container according to claim 5, wherein said auxiliary centering means on said cap is formed as a hollow cylindrical projection (19) having a funnel-shaped recess (29) extending obliquely in an end region of said cylindrical projection, the recess being so dimensioned that said opposed projections (16A, 16B) communicate with the recess (29).

7. A multichamber container according to claim 2, wherein said axial projection (16) has an end region formed as a bung (19) sealing the extraction channel (18).

8. A multichamber container according to claim 1, wherein the inner container (5, 5') has a plurality of concentrically arranged cylindrical chambers (2).

9. A multichamber container according to claim 2, wherein said axial projection (16) is formed as a tube (26) in such a manner that it connects the extraction channel (18) to a chamber of the outer container (3).

10. A multichamber container according to claim 2, wherein the inner container (5, 5') and the axial projection (16) are formed as one part.

11. A multichamber container according to claim 1, wherein the outer container (4, 4', 4'', 4''') is formed so as to be compressible.

12. In a multichamber container having no compressed gas therein and comprising an outer container and an inner container each containing a pourable substance wherein said substances are to be kept separate but to be extracted from said multichamber container as a mixture of said substances, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at said upper side of said inner container being connected to said inner side of said cap with positive locking and in a nonrotational and axially detachable manner;

(c) an outer wall of said inner container having two diametrically opposed projections, each of said projections having a radial, horizontal plane on upper sides thereof; and (d) an inner wall of said outer container having two diametrically opposed projections, each of said projections having an oblique plane on undersides thereof, said projections being formed in such a way that said projections come to communicate with one another by an axial turning of said cap to cause said inner container to be axially detachable from said cap; said cap being provided with a sealable extraction canal.

13. In a multichamber container having no compressed gas therein and comprising an outer container and an inner container each containing a pourable substance wherein said substances are to be kept separate but to be extracted from said multichamber container as a mixture of said substances, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at said upper side of said inner container being connected to said inner side of said cap with positive locking and in a nonrotational and axially detachable manner;

(c) an outer wall of said inner container having two diametrically opposed projections, each of said projections having a horizontal plane on upper sides thereof; and (d) an inner wall of said outer container having two diametrically opposed projections, each of said projections having symmetrically wedge-shaped planes on undersides thereof, said projections being formed in such a way that said projections come to communicate with one another by an axial turning of said cap to cause said inner container to be axially detachable from said cap; said cap being provided with a sealable extraction canal.

14. In a multichamber container having no compressed gas therein and comprising an outer container and an inner container each containing a pourable substance wherein said substances are to be kept separate but to be extracted from said multichamber container as a mixture of said substances, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at the upper side of the inner container being connected to said inner side of said cap with positive locking and in a nonrotational and axially detachable manner;

(c) an outer wall of said inner container having two diametrically opposed projections, each of said projections having symmetrically wedge-shaped planes on upper sides thereof; and (d) an inner wall of said outer container having two diametrically opposed projections, each of said projections having a horizontal plane on undersides thereof, said projections being formed in such a way that said projections come to communicate with one another by an axial turning of said cap to cause said inner container to be axially detachable from said cap; said cap being provided with a sealable extraction canal.

15. In a multichamber container having no compressed gas therein and comprising an outer container and an inner container each containing a pourable substance wherein said substances are to be kept separate but to be extracted from said multichamber container as a mixture of said substances, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at said upper side of said inner container being connected to said inner side of said cap with positive locking and in a nonrotational and axially detachable manner;

(c) an outer wall of said inner container having two diametrically opposed projections; said projections of said inner container being formed cylindrically, obliquely with respect of a longitudinal axis of said multichamber container; and (d) an inner wall of said outer container having two diametrically opposed projections, said projections being formed in such a way that said projections come to communicate with one another by an axial turning of said cap to cause said inner container to be axially detachable from said cap; said cap being provided with a sealable extraction canal.

16. In a multichamber container having no compressed gas therein and comprising an outer container and an inner container each containing a pourable substance wherein said substances are to be kept separate but to be extracted from the multichamber container as a mixture of said substances, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at said upper side of said inner container being connected to said inner side of said cap with positive locking and in a nonrotational and axially detachable manner;

(c) an outer wall of said inner container having two diametrically opposed projections; and (d) an inner wall of said outer container having two diametrically opposed projections, each of said projections having an oblique plane on upper sides thereof, said projections being formed in such a way that said projections come to communicate with one another by an axial turning of said cap to cause said inner container to be axially detachable from said cap; said cap being provided with a sealable extraction canal.

17. In a multichamber container having no compressed gas therein and comprising an outer container and an inner container each containing a pourable substance wherein said substances are to be kept separate but to be extracted from said multichamber container as a mixture of said substances, said substances being combined inside said multichamber container, the improvement comprising (a) said outer container having an upper side; a rotatable cap; and a catch joint, said upper side of said outer container being connected to said rotatable cap with positive locking by said catch joint;

(b) said inner container having an open end at an upper side thereof, said cap having an inner side, said open end at said upper side of said inner container being connected to said inner side of said cap with positive locking and in a nonrotational and axially detachable manner;

(c) an outer wall of said inner container having two diametrically opposed projections; and (d) an inner wall of said outer container having two diametrically opposed projections, each of said projections having symmetrically wedge shaped planes on upper surfaces thereof, said projections being formed in such a way that said projections come to communicate with one another by an axial turning of said cap to cause said inner container to be axially detachable from said cap; said cap being provided with a sealable extraction canal.

18. In a multichamber container(1,1',1'',1''',1'''') having no compressed gas therein and comprising an outer container and an inner container(4,4',4'',4''';5,5',5'',5''') each containing a pourable substance(27,28) wherein said substances are to be kept separate but to be extracted from said multichamber container as a mixture of said substances, said substances(27,28) being combined inside said container(1), the improvement comprising (a) said outer container having an upper side; a rotatable cap and a catch joint, said upper side of said outer container(4,4',4'',4''') being connected to said rotatable cap (6,6') with positive locking by said catch joint(7);

(b) said inner container having an open end at an upper side thereof, said cap having an inner side, said open end at said upper side of said inner container(5,5',5'',5''') being connected to said inner side of said cap with positive locking an in a nonrotational and axially detachable manner;

(c) said inner container(5,5',5'',5''') having at least one projection(11,11',11'',11'''; 12,12',12'', 12''') on an outer wall thereof;

(d) said outer container(4,4',4'',4''') having at least one projection(13,13',13'',13'''; 14,14',14'', 14''') on an inner wall thereof;

(e) said at least one projection of said inner container and said at least one projection of said outer container engaging each other by an axial rotation of said cap of less than 360° to cause said inner container to be axially detachable from said cap; and (f) said cap being provided with a sealable extraction canal.

19. A multichamber container according to claim 18 wherein two of said projections are formed in each of said inner and outer container (13,13',13'',13'''; 14,14',14'',14'''; 11,11',11'',11'''; 12,12', 12'',12''') said two projections in each of said containers being disposed diametrically opposite each other.

* * * * *